US006762666B2

(12) United States Patent
Chu

(10) Patent No.: US 6,762,666 B2
(45) Date of Patent: Jul. 13, 2004

(54) TOROIDAL CORE FOR A TOROID

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 10/139,239

(22) Filed: May 7, 2002

(65) Prior Publication Data

US 2003/0210123 A1 Nov. 13, 2003

(51) Int. Cl.[7] ..... H01F 27/28
(52) U.S. Cl. ..... 336/229; 336/178
(58) Field of Search ..... 336/229, 206, 336/178, 212, 233; 335/210, 213; 324/127; 29/602.1

(56) References Cited

U.S. PATENT DOCUMENTS 4,387,372 A * 6/1983 Smith et al. ..... 340/854.6
6,492,893 B2 * 12/2002 De Graaf ..... 336/229
6,535,096 B1 * 3/2003 Rapoport et al. ..... 336/96

* cited by examiner

*Primary Examiner*—Anh Mai
(74) *Attorney, Agent, or Firm*—Leydig, Voit & Mayer, Ltd.

(57) ABSTRACT

A toroidal core for a toroid, including at least two toroidal rings that are stacked co-axially one upon another. At least one of the two toroidal rings has a body including a gap that forms a break in one side of the body. The gap avoids saturation of the core.

8 Claims, 3 Drawing Sheets

TOROIDAL CORE FOR A TOROID

The present invention relates to a toroidal core for a toroid

BACKGROUND OF THE INVENTION

Toroids are commonly used as current transformers or couplers in electrical equipment or devices such as an earth fault circuit breaker. Over-magnetization leading to saturation of the core of a toroid is undesirable, as this may lead to improper operation and/or overheating.

The subject invention seeks to mitigate or at least alleviate such a problem by providing an improved toroidal core for a toroid.

SUMMARY OF THE INVENTION

According to the invention, there is provided a toroidal core for a toroid, comprising at least two toroidal rings that are stacked co-axially one upon another. At least a first of said at least two toroidal rings has a body including a gap forming a break in one side of the body.

Preferably, the gap extends substantially radially with respect to the body of the first ring.

It is preferred that the gap has a substantially uniform width.

Preferably, the gap is formed at the same time as the body of the first ring is moulded into shape.

It is preferred that the gap is filled up by a non-ferromagnetic filler.

It is further preferred that the filler has an outer surf ace which lies flush with that of the parts of the body of the first ring forming the gap.

It is yet further preferred, that the body of the first ring and the filler are completely covered by an insulating coating.

Preferably, said at least two toroidal rings have respective bodies which have substantially the same outer and inner diameters as one another.

In a first preferred embodiment, the toroidal core includes only two said toroidal rings including one said first toroidal ring.

In a second preferred embodiment, the toroidal core includes at least three said toroidal rings, wherein the first ring is an intermediate ring in the stack.

The invention also provides a toroid incorporating the aforesaid toroidal core, in which the toroid includes at least one winding wound on the toroidal core, whereby said at least two toroidal rings are secured together.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
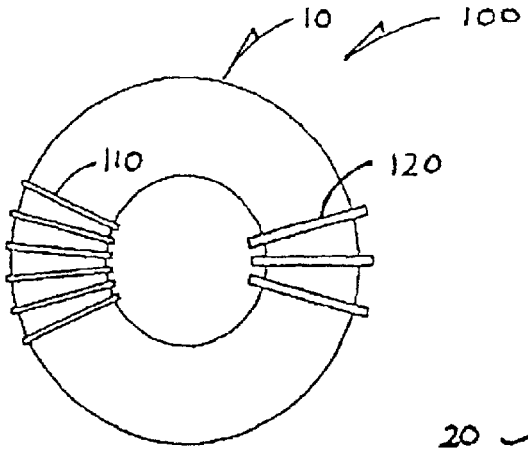
FIG. 1 is a top plan view of a toroid incorporating a first embodiment of a toroidal core in accordance with the invention.
Figure 3:
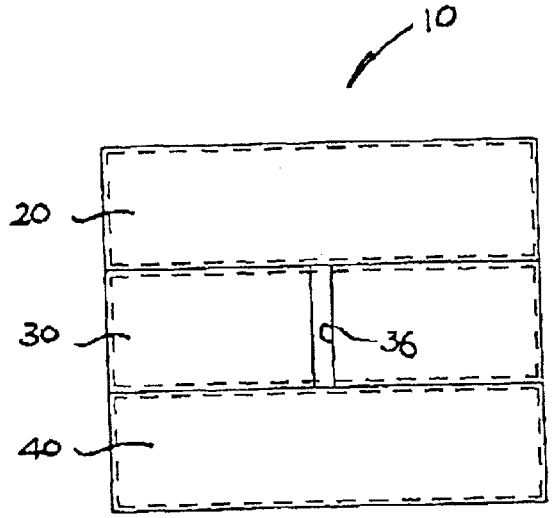
FIG. 3 is a side view corresponding to FIG. 2, showing the toroidal core alone, which is formed by a stack of three toroidal rings.
Figure 2:
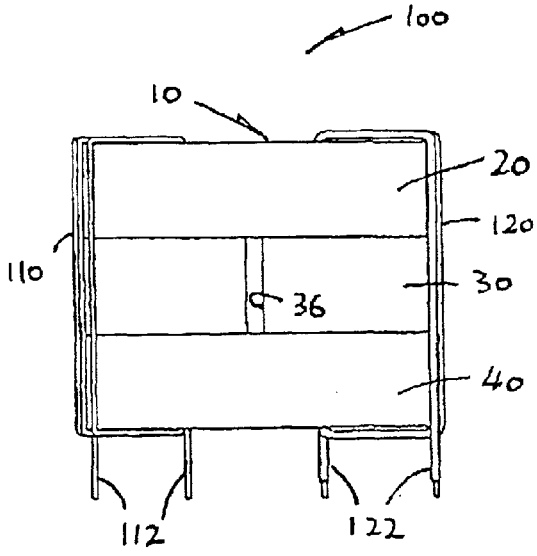
FIG. 2 is a side view of the toroid of FIG. 1.

Referring initially to FIGS. 1 to 3 of the drawings, there is shown a toroid 100 incorporating a first toroidal core 10 embodying the invention, which toroid 100 includes a pair of primary and secondary windings 110 and 120 wound on diametrically opposite sides of the toroidal core 10, each having a pair of terminals 112/122. The windings 110 and 120 may be spread annularly around the toroidal core 10 and overlap with each other.

The toroidal core 10 is formed by a stack of three toroidal rings 20, 30 and 40 placed co-axially one upon another, which are secured together by the coils of the windings 110 and 120. The toroidal rings 20, 30 and 40 have identical shape and dimensions including thickness and in particular the same inner and outer diameters such that they can match with one another and together form a straight tubular structure. The cross-section of each toroidal ring 20/30/40 on each side is a rectangle having round and/or chamfered corners.

Figure 4:
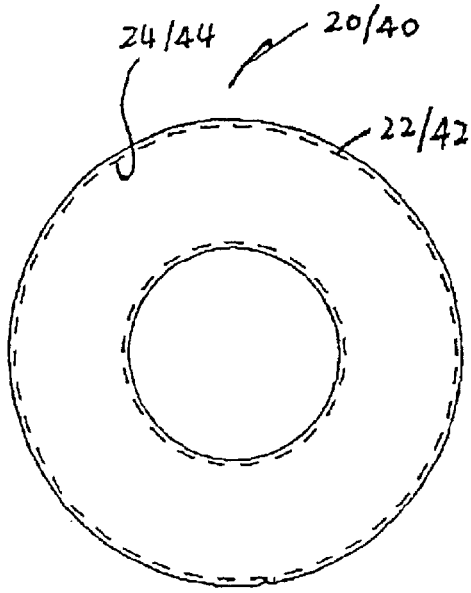
FIG. 4 is a plan view of the top and bottom toroidal rings of FIG. 3.

The top and bottom toroidal rings 20 and 40 have an identical construction, as shown in FIG. 4. Each ring 20/40 has a body 22/42 that is made of a ferromagnetic ferrite material denoted by a code number of PL-3, PL-7, M50, SM100 or KB5 for example as generally known in the art. The surface of body 22/42 is fully covered by a protective coating 24/44 of an epoxy or parylene material for example, that provides insulation between the ring 20/40 and the windings 20 and 30.

Figure 5:
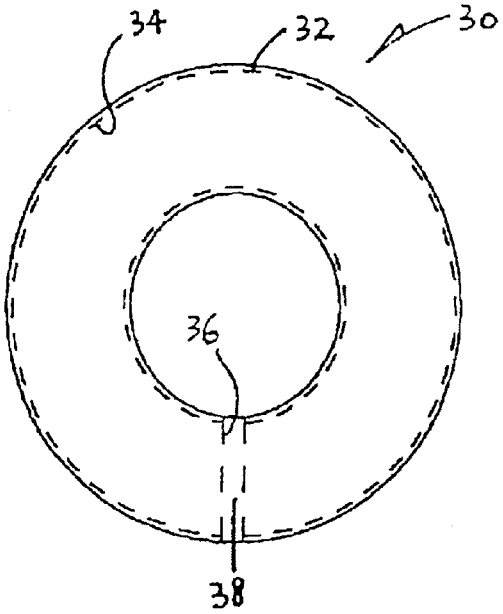
FIG. 5 is a plan view of the middle toroidal ring of FIG. 3.

As shown in FIG. 5, the middle toroidal ring 30 has the same construction in general, i.e. a body 32 covered by a coating 34, except that the body 32 includes a gap 36 forming a break in one side of the body 32. The gap 36 extends radially with respect to the body 32 and through the complete cross-section of the body 32 on that side. The gap 36 is preferably formed at the same time as the body 32 is moulded into shape, or it may later be formed by cutting open one side of the body 32.

The gap 36 is completely filled up or fully occupied by a non-ferromagnetic insulating filler 38 of phenolic or nylon material for example, which may be introduced into the gap 36 while in a molten state and then solidifies or inserted into the gap 36 as a solid insert. The filler 38 in effect removes the gap 36 such that the toroidal body 32 becomes continuous without any physical break. The complete outer surface of the filler 38 lies flush with that of the parts of the body 32 forming the gap 36, whereby any sharp corners and edges resulting from formation of the gap 36 are hidden. Upon application of the coating 34, the gap 36 and filler 38 are completely concealed from sight.

Figure 6:
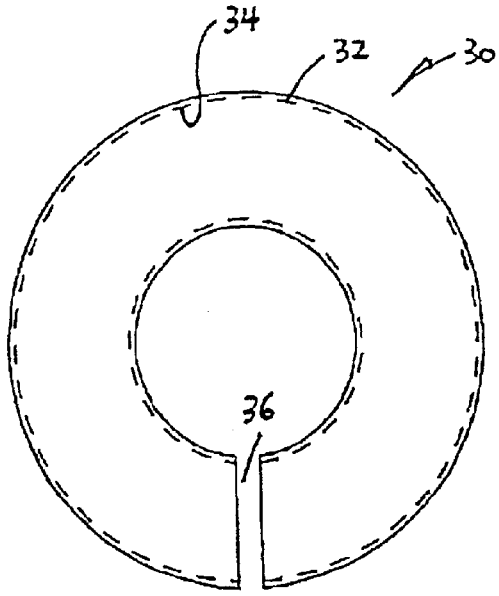
FIG. 6 is a plan view of an alternative middle toroidal ring corresponding to FIG. 5.

FIG. 6 shows an alternative construction of the middle toroidal ring 30, in which the gap 36 is not filled up and thus remains open. The coating 34 preferably extends to cover the opposed inner surfaces of the gap 36.

Figure 7:
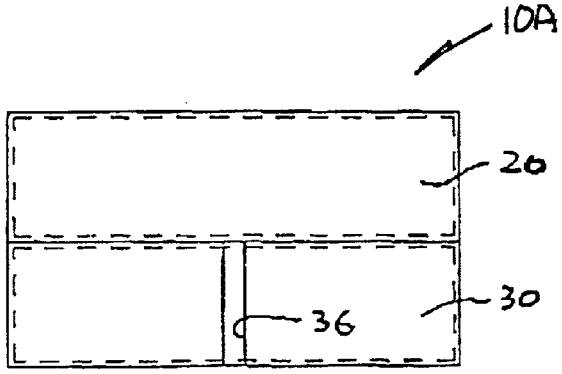
FIG. 7 is a side view of a second embodiment of a toroidal core in accordance with the invention.

Reference is now made to FIG. 7, which shows a second toroidal core 10A embodying the invention for making the toroid 100. This toroidal core 10A has essentially the same construction as the first toroidal core 10, except that it is formed by a stack of only two toroidal rings, i.e. the aforesaid toroidal rings 20 and 30.

In general, the toroidal core of the subject invention comprises a co-axial stack of at least two toroidal rings 20/40 and 30, at least one of which 30 includes the gap 36 on one side, that may or may not be occupied by a filler 38. The gap 36 can be of any uniform width but is preferably as narrow as practically possible. The toroidal ring 30 including the gap 36 is preferably sandwiched by two toroidal rings 20 and 40 that are without a gap, or is at least an intermediate ring in the stack.

Figure 8:
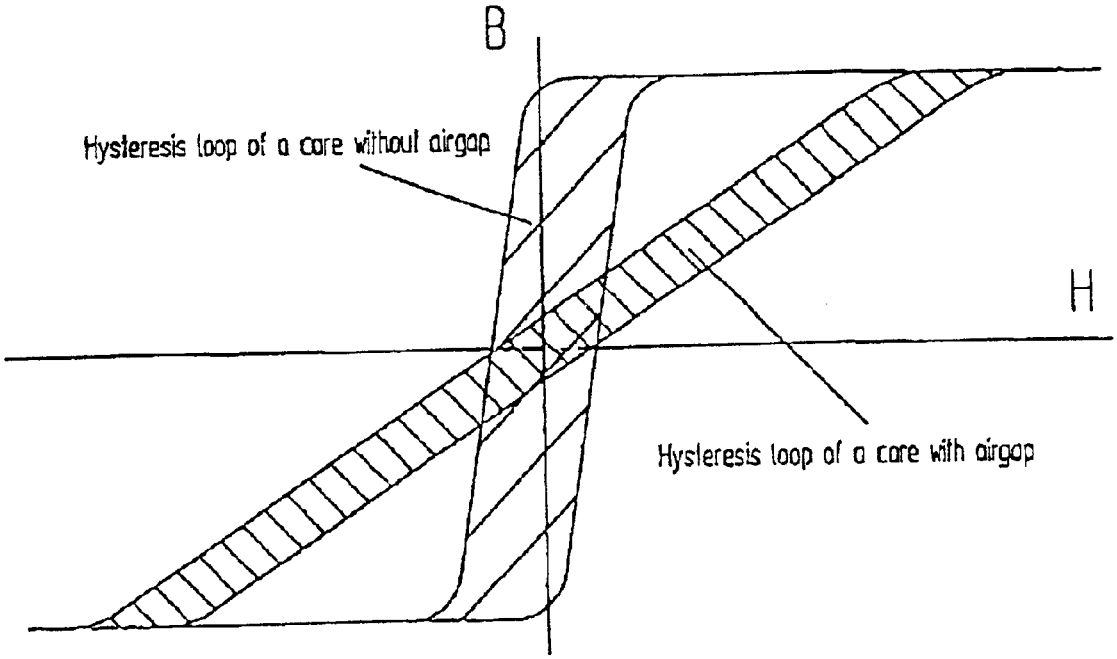
FIG. 8 is a graph showing the hysteresis loop during operation of the toroidal core of FIG. 1 or 7.

The gap 36 acts as an air gap to the magnet flux when the toroidal core 10/10A is magnetized, forming a break in the magnetic flux path. An extra magnetizing force will be required to excite the air gap 36, in addition to the normal magnetizing force needed to excite the material of the core 10/10A itself. Accordingly, the hysteresis loop rotates clockwise about its origin, as shown in FIG. 8. This results in a relatively slow rise or fall of the otherwise steeply rising or falling sections of the hysteresis loop, compared with a typical toroidal core without an air gap. The hysteresis loop is therefore markedly tilted, with its area extending to cover a relatively wider range of magnetizing force (H), whereby over-magnetization leading to saturation of the core 10/10A is less likely to occur.

As the magnetic reluctance of the air gap 36 (with or without the filler 38) is considerably larger than that of the material of the toroidal core 10/10A, the magnetizing force required to create a certain flux density within the core 10/10A is effectively determined by the reluctance of the air gap 36 alone. For the same area within the hysteresis loop, the hysteresis losses and Eddy current losses are practically unaffected by the existence of the air gap 36. Thus, the real core losses (but not the apparent VA losses) and heating of the core 10/10A will not change.

It is envisaged that the toroidal core of the subject invention may comprise more than three toroidal rings stacked together, and may include more than one toroidal ring having a gap, which is preferably arranged in the middle of the stack.

The invention has been given by way of example only, and various other modifications and/or variations to the described embodiments may be made by persons skilled in the art without departing from the scope of the invention as specified in the accompanying claims.

What is claimed is:

1. A toroidal core for a toroid, the core comprising at least two toroidal rings that are stacked co-axially, one upon another, at least a first of the at least two toroidal rings having a body including a gap forming a break in one side of the body;

a non-ferromagnetic filler filling the gap, the filler having an outer surface that lies flush with parts of the body of the first ring forming the gap; and an insulating coating completely covering the body of the first ring and the filler.

2. The toroidal core as claimed in claim 1, wherein the gap extends substantially radially with respect to the body of the first ring.

3. The toroidal core as claimed in claim 1, wherein the gap has a substantially uniform width.

4. The toroidal core as claimed in claim 1, wherein the gap is formed at the same time as the body of the first ring is moulded in shape.

5. The toroidal core as claimed in claim 1, wherein the at least two toroidal rings have respective bodies which have substantially the same outer and inner diameters as one another.

6. The toroidal core as claimed in claim 1, including only two of the toroidal rings and one of the first toroidal rings.

7. The toroidal core as claimed in claim 1, including at least three of the toroidal rings, wherein the first ring is an intermediate ring in the stack.

8. A toroid incorporating the toroidal core as claimed in claim 1, wherein the toroid includes at least one winding wound on the toroidal core, whereby the at least two toroidal rings are secured together.

* * * * *